United States Patent [19]

Nishizawa et al.

[11] Patent Number: 4,493,858

[45] Date of Patent: Jan. 15, 1985

[54] METHOD FOR INSULATING SLOTS IN ROTORS OF ELECTRICAL ROTATING MACHINES

[75] Inventors: Hiroshi Nishizawa; Tadayuki Sato; Takashi Ishikawa, all of Mie, Japan

[73] Assignee: Tokyo Shibaura Denki Kabushiki Kaisha, Kawasaki, Japan

[21] Appl. No.: 428,331

[22] Filed: Sep. 29, 1982

[30] Foreign Application Priority Data

May 26, 1982 [JP] Japan ..... 57-89169

[51] Int. Cl.[3] ..... B05D 5/12

[52] U.S. Cl. ..... 427/104; 427/235; 427/238; 427/239; 427/318

[58] Field of Search ..... 427/104, 235, 318, 238, 427/239, 105; 310/45

[56] References Cited

U.S. PATENT DOCUMENTS

| | | | |
|---|---|---|---|
| 3,025,188 | 3/1962 | Larsh et al. | 427/104 |
| 3,537,875 | 11/1970 | Kerr | 427/104 |
| 3,579,788 | 5/1971 | Fritzsche | 310/45 |

OTHER PUBLICATIONS

"Stray-Load Losses and Stray Torques in Induction Machines" by Adnan M. Okok, Associate Member AIEE, Trans. AIEE 1958, Apr. 1977, p. 50 FIG. 11, p. 52.

"Change of Stray Loss of a Cage Induction Motor With Axial Variation of the Interbar Resistance" by O. I. Butler, vol. 118, and others Proc. IEE, vol. 118, No. 7, Jul. 1971, pp. 884–886.

"H. F. Stray Load Losses in Cage Induction Motors" by B. J. Chalmers, Ph.D., Electrical Times, Nov. 16, 1967, pp. 785–787.

*Primary Examiner*—Norman Morgenstern
*Assistant Examiner*—K. E. Jaconetty
*Attorney, Agent, or Firm*—Oblon, Fisher, Spivak, McClelland & Maier

[57] ABSTRACT

A method for insulating slots of a rotor in an electrical rotating machine comprises steps of removing punching oil from a rotor core assembly by heating only the interior of the slots to a high temperature while axially compressing the rotor core assembly, applying a liquid electric insulating paint to the inner wall surfaces of the slots by introducing the paint only into the slots and then discharging the paint from the slots while pressurizing the rotor core assembly, applying a negative pressure to the lower ends of the slots to remove the paint collected at the lower ends of the slots, and heating at least the interior of the slots to bake the paint on the inner wall surfaces of the slots.

10 Claims, 10 Drawing Figures

METHOD FOR INSULATING SLOTS IN ROTORS OF ELECTRICAL ROTATING MACHINES

BACKGROUND OF THE INVENTION

This invention relates to a method for insulating slots in rotors of electrical rotating machines, especially cage type induction motors.

In a prior art cage type induction motor, rotor bars are formed in slots of a rotor by casting, and the slots are insulated to prevent the rotor bars from being short-circuited to cause stray-load loss or to produce stray torque during the operation of the motor.

In insulating the slots, a laminated rotor core assembly formed of a fixed number of laminated rotor punchings is immersed first in a solvent such as acetone to remove punching oil used in punching rotor blanks, and then in a heat-resisting insulating liquid paint or coating. After the laminated rotor core assembly is taken out of the paint or coating, excessive paint in the slots is removed by blowing compressed air into the slots. Thereafter, the assembly is kept in a drying furnace at a predetermined temperature for a given period of time to bake the insulating paint on the inner surfaces of the slots.

After insulating the slot, a cast rotor is manufactured by die-casting aluminium or similar material.

However, the aforementioned method is subject to the following drawbacks.

(1) The solvent used for the removal of the punching oil penetrates into the gaps between the laminated rotor punchings. Accordingly, much solvent is consumed, and in addition, the removal of the solvent requires an extra step of heating it or letting it stand for several hours. From the point of view of environmental sanitation, moreover, an off-line system is essential to the removal of the solvent. Thus, the number of manufacturing processes and cost are increased.

(2) When the rotor core assembly is immersed in the insulating paint, the paint is excessively attached to the shaft hole and the outer peripheral surface of the assembly. Removal of the excessive paint requires a laborious process.

(3) In the immersion process, the insulating paint enters the gaps between the laminated rotor plates by capillarity or a capillary action, leading to much paint consumption. This is not ecomonical. Further, the capillarity will lower the space factor of the rotor core assembly and increase the magnetic resistance of the rotor. Therefore, the exciting current of the rotor is increased so that the power factor of the motor is reduced. Moreover, in the die casting process after the baking process, an axial die fastening pressure is applied to the rotor core assembly to cause cracks or breakage at those portions of the insulating coating film which cover the edge portions of the slots of the rotor punchings. Thus, the insulation between the rotor core assembly and the rotor bars is lowered.

(4) The excessive insulating paint in the slots is removed by allowing it to stand for a time or by blowing away by the use of compressed air. According to the former method, however, the paint is collected at the lower end portions of the slots of the rotor core assembly by surface tension, so that nonconductivity may occur during die casting and impair the electric characteristics of the rotor. According to the latter method, the thickness of the coating films on the inlet portions of the inner walls of the slots where the air is led becomes thinner. Thus, the coating films may be peeled off that inlet portion to lower the insulation effect.

(5) In the conventional art, the coating is dried and hardened by an indirect heating method using ambient air in an electric furnace or the like after insulation treatment. According to this method, however, unduly great thermal energy is consumed, since heat is applied not only to the inner walls of the slots of the rotor punchings, but also to other portions of the rotor punchings which require no heating at all. Moreover, this method requires an additional step and more time for cooling the unnecessarily heated portions.

(6) In the baking process after the insulating treatment, the temperature of the rotor core assembly must be suddenly increased for a very short period of time if the baking temperature of the insulating paint is high, or if the paint is water-soluble. As a result, bubbles will be produced in the insulating paint to lower its electric insulating capability.

These drawbacks would lead to variations in the quality of rotors, and constitute a serious obstacle to the mass production of the rotors.

SUMMARY OF THE INVENTION

The object of this invention is to provide a method for insulating slots of rotors of electrical rotating machines, obviating the aforementioned drawbacks of the prior art methods and suited for mass production of rotors.

According to this invention, there is provided a method for insulating slots of a rotor of an electrical rotating machine, which comprises steps of removing punching oil from a rotor core assembly formed of laminated rotor punchings each having slots, by heating only the interior of the slots to a high temperature while compressing the rotor core assembly axially, applying a liquid, electric insulating paint to the inner wall surfaces of the slots by introducing the paint only into the slots while pressurizing the rotor core assembly, discharging the paint from the slots by applying a negative pressure to the lower ends of the slots to remove the paint collected at the lower ends of the slots, and heating at least the interior of the slots to bake the paint on the inner wall surfaces of the slots. These steps are carried out succesively in a single production line.

DETAILED DESCRIPTION OF THE PREFERRED EMBODIMENTS

There will now be described a method for insulating slots of a rotor of a cage type induction motor as an electrical rotating machine according to this invention with reference to the accompanying drawings.

Figure 1:
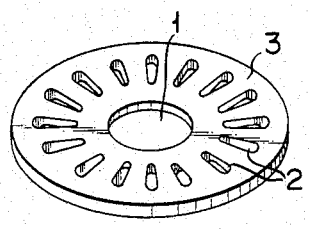
FIG. 1 shows a perspective view of a rotor punching.
Figure 2:
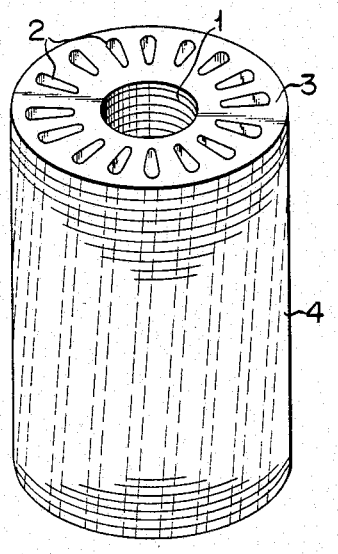
FIG. 2 shows a perspective view of a rotor core assembly.

The rotor of the cage type induction motor will now be described. As shown in FIG. 1, a number of doughnut-shaped rotor punchings 3 each having an axial central hole 1 and a number of circumferentially arranged slots 2 are manufactured from a magnetic steel sheet by punching dies and using punching oil.

Then, a rotor core assembly 4 is formed by laminating the rotor punchings 3 so that their slots 2 communicate with one after another but are twisted at a predetermined small angle. When the rotor blanks 3 are punched out therefrom, projections are formed on the magnetic steel sheet. These projections engage one another to fix the rotor blanks 3 to one another as the rotor plates 3 are stacked.

Figure 3:
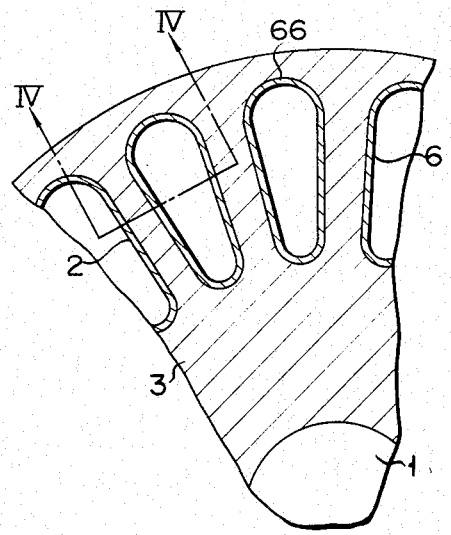
FIG. 3 shows a cross-sectional view of the rotor core with an electric insulating paint baked thereon.
Figure 4:
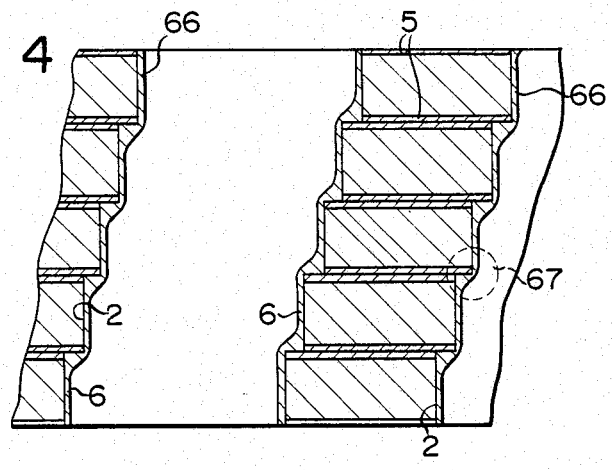
FIG. 4 shows a sectional view as taken along line IV—IV of FIG. 3.

As shown in FIG. 4, the magnetic steel sheet has electric insulating films 5 previously formed on both sides thereof. However, when each rotor punching 3 is cut out from the steel sheet, steel is exposed to the atmosphere on the inner wall surfaces 6 (FIGS. 3 and 4) of the slots 2, and must be electrically insulated. This insulation can be achieved highly economically and effectively by the method of this invention.

First, there will be described a process for removing punching oil from the rotor core assembly 4 as a first step of the method of the invention.

Figure 5:
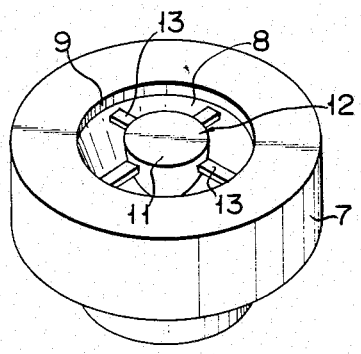
FIG. 5 shows a perspective view of a base used in punching oil removal and paint application processes.
Figure 6:
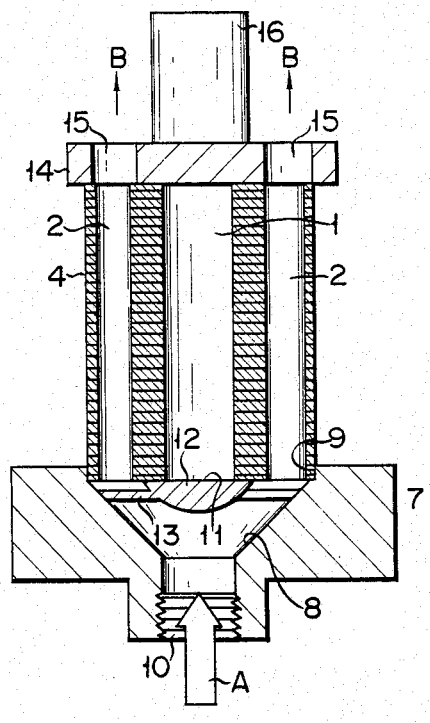
FIG. 6 shows an axial sectional view of an apparatus used in the punching oil removal process.

As shown in FIG. 6, the rotor core assembly 4, formed of a given number of laminated rotor punchings 3, is placed on a base 7 so that the axial hole 1 is positioned vertically. As shown in FIGS. 5 and 6, the base 7 has an inversely truncated conical chamber 8, an annular receiving portion 9 formed in the upper end portion of the chamber 8 and having a diameter substantially equal to that of each rotor punchings 3, and a bore 10 opening into the lower end of the chamber 8. The base 7 also includes a central masking seat 12 having a circular top surface 11 whose diameter is larger than that of the axial central hole 1 of the rotor core assembly 4, but is not so large as to reach the slots 2. The masking seat 12 is fixed to the main body of the base 7 by means of radially extending ribs 13 so that the circular top surface 11 is flush with the lower edge of the annular receiving portion 9 and is coaxial with the annular receiving portion 9.

When the rotor core assembly 4 is disposed on the base 7, the axial hole 1 of the assembly 4 is entirely sealed in a fluid-tight manner by the masking seat 12, though the slots 2 completely communicate with the chamber 8.

Then, a discoid pressing jig 14 with a diameter greater than that of the rotor core assembly 4 is coaxially put on the top of the assembly 4. Vent holes 15 larger than the slots 2 are formed circumferentially in the pressing jig 14, so as to match the corresponding slots 2.

The pressing jig 14 is pressed against the rotor core assembly 4 by a press ram 16.

In operation, after the bore 10 of the base 7 in the state of FIG. 6 is connected to a hot air generator (not shown), the generator is actuated. Then, hot air enters the chamber 8 through the bore 10, as indicated by an arrow A. The air is supplied only to the slots 2 to dry and remove the punching oil on the inner wall surfaces 6 of the slots 2. When the press ram 16 is actuated simultaneously with the hot air supply, the rotor core assembly 4 is axially compressed to force out the punching oil between the adjacent rotor punchings 3 into the slots 2. Then, the punching oil in the slots 2 is removed by drying with the hot air. The hot air carrying the punching oil is discharged through the vent holes 15, as indicated by arrows B to a punching oil treating device (not shown).

Thus, by the use of the masking seat 12, the hot air is allowed to be supplied only to the slots 2 which are necessary for the removal of the punching oil, and is prevented from being supplied to other parts including the axial hole 1. Accordingly, thermal energy used can be minimized.

Moreover, the use of the press ram 16 makes it possible to remove the punching oil between the rotor punchings 3, as well as the oil sticking to the inner wall surfaces 6 of the slots 2. Thus, it is possible to eliminate any trouble caused by residual punching oil.

Figure 9:
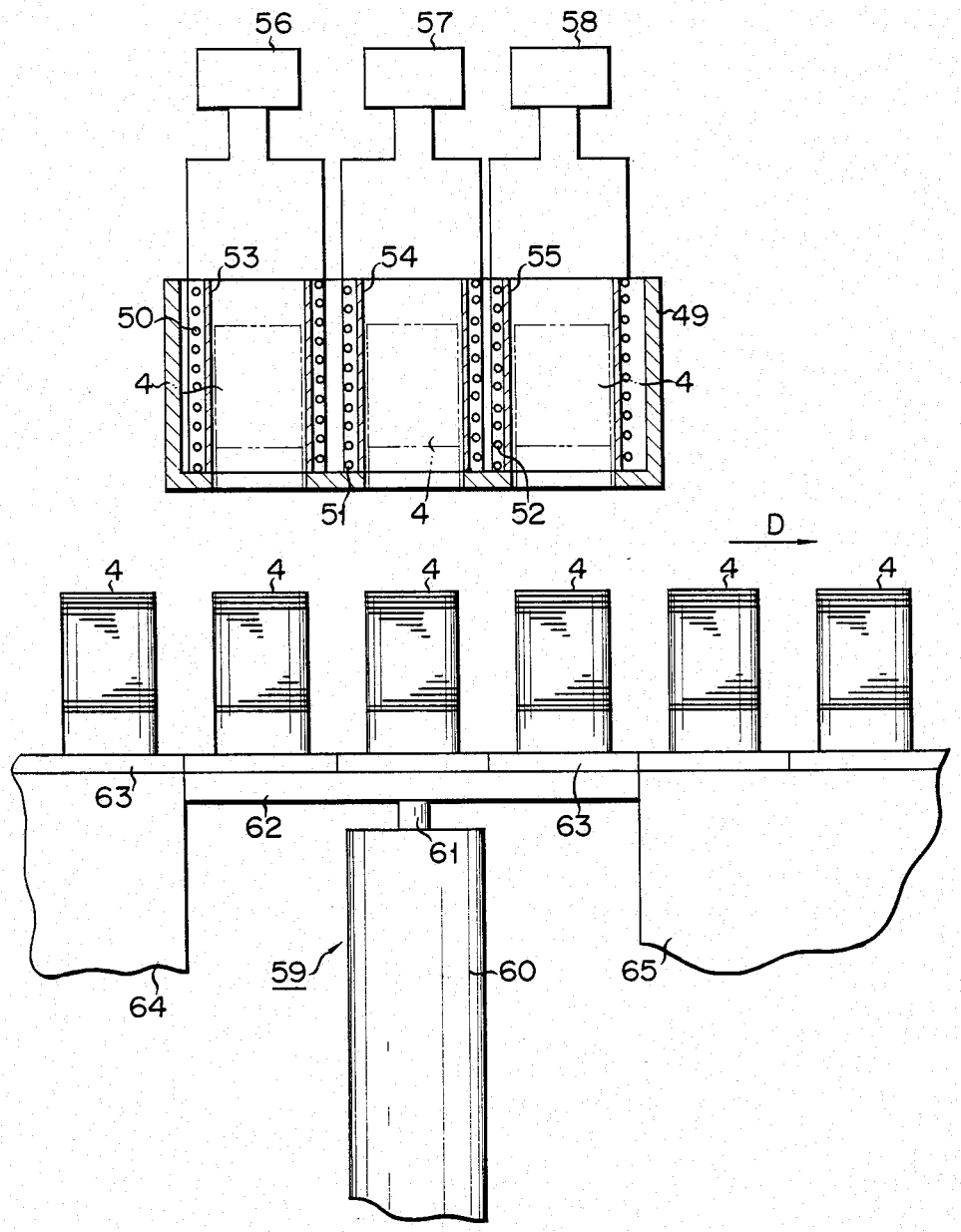
FIG. 9 shows a schematic view of a paint baking apparatus.

The punching oil may be removed also by using a high-frequency induction heater as shown in FIG. 9.

Figure 7:
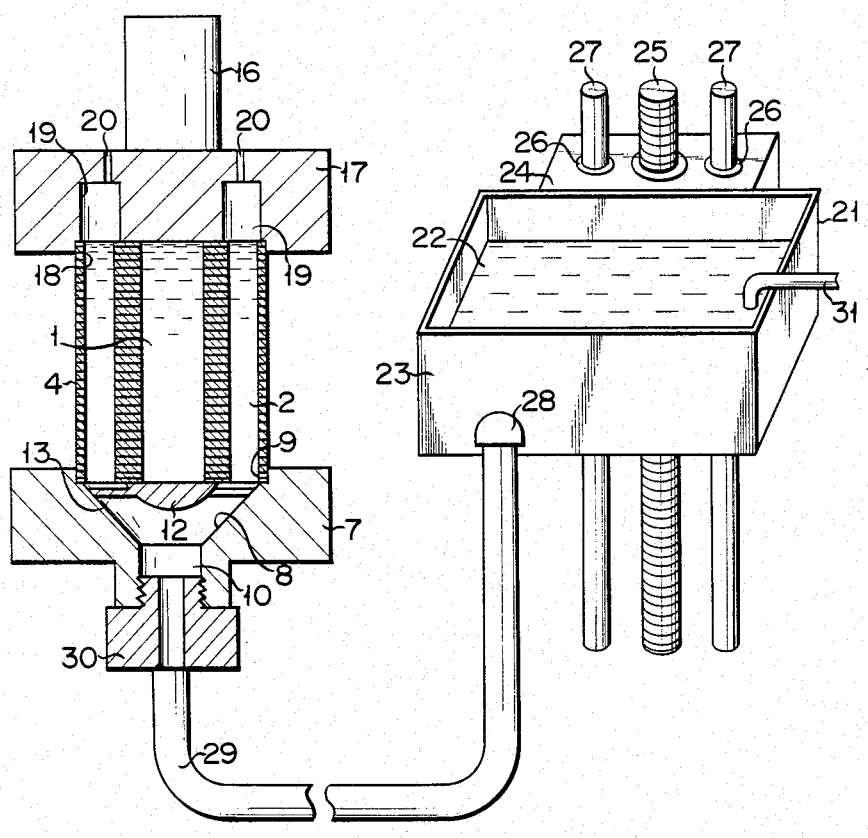
FIG. 7 shows a combination of an axial sectional view of an apparatus used in the paint application process and a perspective view of a paint supplying apparatus.

After the removal of the punching oil, an electric insulating paint or coating is applied to the inner wall surfaces 6 of the slots 2 by using an apparatus shown in FIG. 7.

In this process, a pressing jig 17 with a diameter greater than that of the rotor core assembly 4 is used in place of the pressing jig 14.

An annular receiving portion 18 having an inner diameter substantially equal to the outer diameter of the rotor core assembly 4 is formed in the lower surface of the pressing jig 17, and receives the upper end portion of the rotor core assembly 4.

Formed in the pressing jig 17 also are escape holes 19 communicating with the respective slots 2 and air passages 20 connecting the escape holes 19 and the atmosphere.

A paint supplying apparatus 21, whose principal part is shown in FIG. 7, has a paint reservoir 23 which contains a heat-resisting insulating liquid paint or coating 22 comprising, for example, diammonium hydrogen phosphate and goethite dissolved in water. A block 24 is formed on one side wall of the paint reservoir 23. A vertical screw rod 25 driven in both rotational directions by a drive mechanism (not shown) is screwed in the block 24 to elevate and lower the paint reservoir 23. The block 24 is fitted with bushes 26 through which guide bars 27 pass parallel to the vertical screw rod 25. The vertical screw rod 25 and the guide bars 27 are supported by a bed (not shown). A paint outlet 28 is formed in one side wall of the paint reservoir 23, and one end of a flexible tube 29 (e.g., a hose) is fixed to the outlet 28. The other end of the tube 29 is connected to the bore 10 of the base 7 by means of a fixture 30. A pipe 31 is used for supplying the paint from a paint tank (not shown) to the paint reservoir 23.

In operation, the bed 7 is first disconnected from the hot air generator, and the pressing jig 14 used in the preceding process for the removal of punching oil is removed from the rotor core assembly 4. Then, the pressing jig 17 is located on the rotor core assembly 4 so that the upper end portion of the rotor core assembly 4 is fitted in the annular receiving portion 18, and the escape holes 19 are in alignment with their corresponding slots 2. Then, the rotor core assembly 4 is strongly pushed by the press ram 16 through the pressing jig 17 to allow no gaps between the rotor punchings 3.

Subsequently, the screw rod 25 is rotated to lower the paint reservoir 23 so that the level of the liquid paint 22 comes below the lower end of the base 7. After the fixture 30 is screwed into the bore 10, the screw rod 25 is turned in the reverse direction to raise the paint reservoir 23 until the level of the paint 22 reaches that of the upper end of the rotor core assembly 4. As the paint reservoir 23 is raised, the paint 22 flows in the slots 2 through the bore 10, gradually raising its level to reach the upper end of the core assembly 4. Thus, the paint 22 sticks to the inner walls of the slots 2, covering every corner thereof. As the paint 22 flows in the slots 2, hot air in the slots 2 enters the escape holes 19, and then passes through the air passages 20 to escape into the atmosphere. Then, the screw rod 25 is rotated to lower the paint reservoir 23 until the level of the paint 22 comes below the fixture 30. The lowering speed of the paint reservoir 23 is adjusted in inverse proportion to the viscosity of the paint 22 so that the paint 22 may uniformly stick to the inner wall surfaces 6 of the slots 2.

In this process, the rotor core assembly 4 is pressed by the press ram 16, thus preventing the paint 22 from entering the gaps between the rotor punchings 3. Accordingly, there is no danger that the electric property of the rotor will be damaged nor that the paint 22 will be wasted.

It is expedient that pipes for the supply of the hot air and paint to the base 7 be connected before the hot air or paint enters the bore 10 of the base 7, and that the hot air and paint be supplied selectively to the base 7 by means of a change-over valve.

After the aforementioned paint application process is completed, part of the paint 22 sticking to the inner wall surfaces 6 of the slots 2 falls along the same to form swollen masses at the lower edges of the slots 2.

Figure 8:
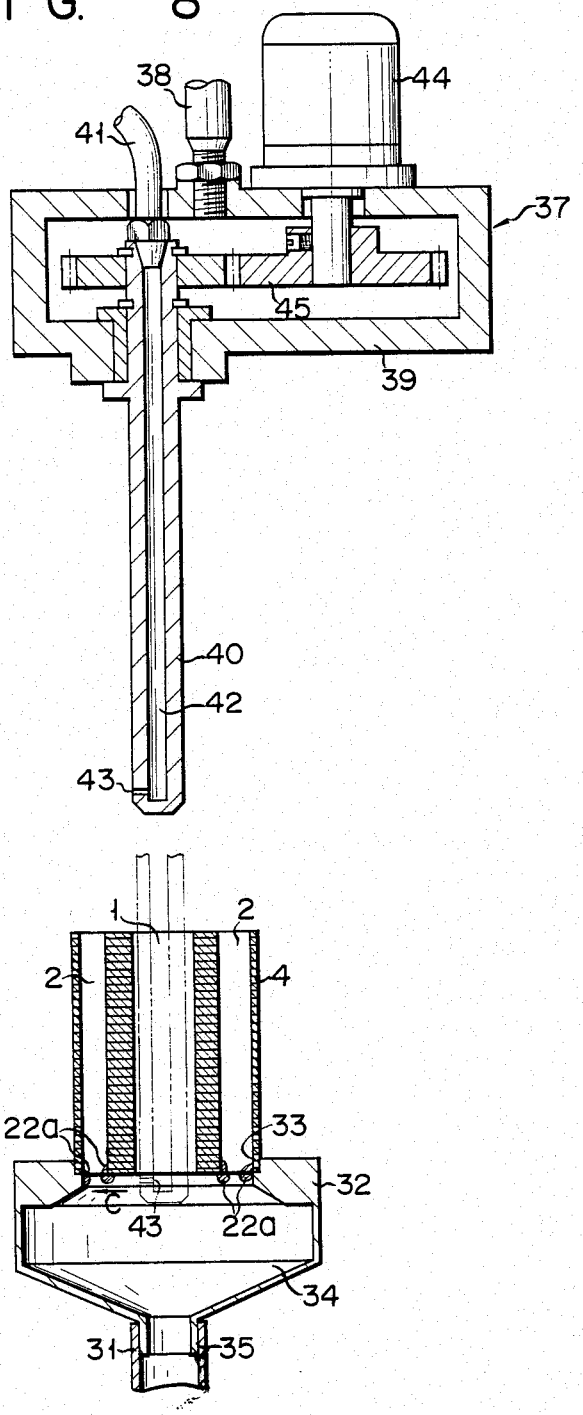
FIG. 8 shows an axial sectional view of an apparatus used in a residual paint removal process.

In the next process, the masses **22*a* of paint are removed by using a residual paint removing apparatus as shown in FIG. 8. In this apparatus, a hopper 32 is provided with annular portion 33 having an inner diameter substantially equal to the outer diameter of the rotor core assembly 4. The hopper 32 includes the annular receiving portion 33 to receive the lower end of the rotor core assembly 4, and an inversely truncated conical chamber 34 connecting with the annular receiving portion 33. A waste pipe 31 for carrying used paint into a waste tank (not shown) is connected to an outlet 35 of the hopper 32 at the lower end of the chamber 34**.

An air stream generating unit 37 has a housing 39 which is moved up and down by a piston 38. The piston 38 is vertically moved by a cylinder (not shown) fixed to the frame (not shown) of the residual paint removing apparatus. A mandrel 40 coaxial with the axial central hole 1 of the rotor core assembly 4 protrudes downward from the housing 39.

The outer diameter of the mandrel 40 is smaller than the diameter of the axial central hole 1, and that portion of the mandrel 40 which extends below the under surface of the housing 39 is longer than the rotor core assembly 4. The mandrel 40 is provided with a vertical air passage 42 whose lower end is closed and whose upper end is connected to a compressed air supply apparatus (not shown) through a tube 41. One or more orifices 43 extending in the radial direction of the mandrel 40 are formed in the side wall of the mandrel 40 at the lower end portion of the air passage 42.

An electric motor 44 is mounted on the housing 39 to rotate the mandrel 40 at a desired speed through a gear train 45 arranged in the housing 39.

There will now be described a removal process using the aforementioned residual paint removing apparatus. First, the rotor core assembly 4 to which the paint has been applied is transferred from the base 7 to the hopper 32. Then, the piston 38 is actuated to lower the mandrel 40 together with the housing 39 so that the orifice or orifices 43 are located several millimeters below the underface of the rotor core assembly 4, as indicated by chain lines in FIG. 8. Thereafter, when the motor 44 starts to feed compressed air into the air passage 42 in the mandrel 40 through the tube 41, the air is blown off parallel to the underface of the rotor core assembly 4 and radially outward from the orifice or orifices 43. As the mandrel 40 rotates, a negative pressure is produced near the lower end portions of the slots 2 by an air stream from the orifice or orifices 43 when the air stream passes right under the slots 2. Swollen masses **22*a* of paint collected at the lower end portions of the slots 2 are removed by the negative pressure. The swollen masses 22*a* removed in this manner are dropped in the chamber 34 to be discharged through the pipe 31 or returned to the paint reservoir 23** for reuse. Thus, the residual paint removal process is completed.

If a single orifice 43 is used, the residual paint at the slots 2 is removed when the mandrel 40 makes one revolution. If a plurality of orifices 43 are used on the other hand, the rotation angle of the mandrel 40 which will permit negative pressure to be applied to the lower end of each slot 2 one time is inversely proportional to the number of orifices 43, thereby improving the efficiency of the removal of the residual paint. The final process is a paint baking process. FIG. 9 shows a baking apparatus according to one embodiment of the invention.

A high-frequency baking unit 49 is fixed to the frame (not shown) of the baking apparatus, for example. Windings 53, 54 and 55 are arranged side by side at regular intervals in the high-frequency baking unit 49. The windings 53, 54 and 55 are formed by winding coils 50, 51 and 52, respectively, on corresponding bobbins having an inner diameter greater than the outer diameter of the rotor core assembly 4. The coils 50, 51 and 52 are connected to high-frequency power sources 56, 57 and 58, respectively. Each power source has a higher power source than does one on its left so that each winding produces greater heat than does the one on its left.

An elevating unit 59 for the rotor core assemblies 4 is disposed right under the high-frequency baking unit 49. The elevating unit 59 includes a vertical piston cylinder 60 fixed to a bed, and a horizontal supporting base 62 fixed to a piston head 61. The rotor core assemblies 4 are set on the horizontal supporting base 62 so as to be coaxial with the windings 53, 54 and 55. The stroke of the piston cylinder 60, that is, the vertical stroke of the horizontal supporting base 62 is so set that the rotor core assemblies 4 are moved between the position where they are entirely inserted in their corresponding windings 53, 54 and 55, as indicated by chain lines in FIG. 9, and the position where they are fully removed from the windings, as indicated by full lines.

The rotor core assemblies 4 are supported individually by supporting plates 63 each having a length equal to the distance between the centers of each two adjacent windings.

A rotor core assembly feeding apparatus 64 and a rotor core assembly delivery apparatus 65 are disposed on the left and right of the horizontal supporting base 62, respectively. With every stroke of the piston-cylinder assembly 60, each rotor core assembly 4 is moved a distance equivalent to the length of the supporting base 63 in the direction indicated by an arrow D by, for example, a belt conveyor.

In the aforementioned baking apparatus, after the high-frequency power sources 56, 57 and 58 have been turned on and the piston-cylinder assembly 60 is actuated. The rotor core assemblies 4 on the horizontal supporting base 62 enter the inner spaces of their corresponding windings 53, 54 and 55. Then, the paint 22 sticking to the inner wall surfaces 6 of the slots 2 is baked onto the inner wall surfaces 6. After the baking has been finished, the rotor core assemblies 4 are lowered by the piston-cylinder assembly 60. The rotor core assemblies 4 are fed successively in the direction indicated by the arrow D with every stroke of the piston-cylinder 60. Thus, the feed and delivery of the rotor core assemblies 4 and the paint baking are carried out automatically.

The rotor core assemblies 4 on the horizontal supporting base 62 are heated at gradually increasing temperatures by the windings 53, 54 and 55 as many times as the number of the windings used (three times in this embodiment). Thus, electric insulating layers 66 are baked on the inner wall surfaces 6 of the slots 2, as shown in FIGS. 3 and 4, without causing any noticeable thermal distortion of the rotor punchings 3. Accordingly, no damage is caused at the slot edge portion of each rotor punching 3 as enclosed in a dotted-line circle 67 in FIG. 4. Moreover, the stepwise heating suppresses the sudden evaporation of the solvent of the paint 22 and the consequential foaming of the paint 22 which in turn leads to a decline in an electric insulation of the paint 22.

Since magnetic flux is concentrated on the outer peripheral edges of the rotor punchings 3 by high-frequency induction heating, the slots 2 and their adjoining portions are heated intensively. Thus, the energy efficiency is improved.

Figure 10:
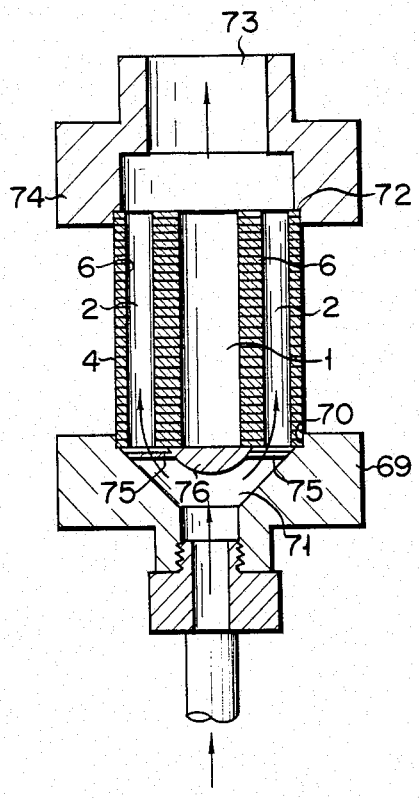
FIG. 10 is an axial sectional view of another embodiment of the paint baking apparatus.

FIG. 10 shows another embodiment of the baking apparatus. A base 69 is provided at its top portion with an annular receiving portion 70 to receive the lower end of the rotor core assembly 4, an inversely truncated conical chamber 71 communicating with the annular receiving portion 70, and a masking seat 76 located in the center of the chamber 71 by means of radial extending ribs 75 so as to cover the axial central hole 1 of the rotor core assembly 4. The chamber 71 is connected at its bottom to a hot air supplying apparatus (not shown). Disposed on the upper end of the rotor core assembly 4 is a pressing member 74 which is provided in its underface with an annular receiving portion 72 to receive the upper end of the assembly 4, and an air passage 73 communicating with the axial central hole 1 and the slots 2 and connected to a suitable exhaust apparatus.

When hot air is introduced through the chamber 71 of the base 69, it flows through the slots 2 to heat the rotor punchings 3, thereby baking the paint 22 on the inner wall surfaces 6 of the slots 2.

According to this invention, as described above, the punching oil removal, paint application, residual paint removal, and paint baking processes may be carried out in the above-mentioned order in an on-line system. Moreover, electric insulating films with uniform thickness can be stably formed on the inner wall surfaces of the slots of rotors of electrical rotating machines without wasting the insulating paint or coating and using less thermal energy. Accordingly, the inner wall surfaces of the slots can be electrically insulated in a system of mass production. Thus, it is possible to mass-produce electrical rotating machines with less stray load loss and less stray torque.

What is claimed as new and desired to be secured by Letters Patent of the United States is:

1. A method for insulating slots in a rotor of an electrical rotating machine, said rotor comprising a rotor core assembly formed of laminated rotor punchings each having said slots, said method comprising the steps of:

removing punching oil from the inner surface of said rotor core assembly by heating only the interior of said slots to a high temperature while axially compressing said rotor core assembly;

applying a liquid electric insulating paint to the inner wall surfaces of said slots by introducing said paint only into said slots and then discharging said paint from said slots while axially compressing said rotor core assembly;

applying a negative pressure to the lower ends of said slots to remove said paint collected at said lower ends of said slots; and heating at least the interior of said slots to bake said paint on the inner wall surfaces of said slots.

2. The method according to claim 1, wherein said paint is baked by a stepwise increase of temperature.

3. The method according to claim 1 or 2, wherein said punching oil is removed by blowing hot air into said slots.

4. The method according to claim 1 or 2, wherein said punching oil is removed by high-frequency induction heating.

5. The method according to claim 1 or 2, wherein said paint is applied to the inner wall surfaces of said slots by raising and lowering the surface level of said paint introduced through the lower ends of said slots.

6. The method according to claim 5, wherein said paint is discharged at a speed inversely proportional to the viscosity of said paint.

7. The method according to claim 1 or 2, wherein said negative pressure is produced by an air stream caused to flow substantially at right angles to said slots at said lower ends of said slots.

8. The method according to claim 1 or 2, wherein said negative pressure is produced by sucking air from the interior of said slots.

9. The method according to claim 1 or 2, wherein said heating is attained by high-frequency induction heating.

10. The method according to claim 1 or 2, wherein said heating is attained by passing hot air through said slots.

* * * * *